United States Patent [19]

Sahatjian

[11] Patent Number: 4,909,510

[45] Date of Patent: Mar. 20, 1990

[54] SPORTS RACQUET NETTING

[76] Inventor: Ronald A. Sahatjian, 29 Saddle Club Rd., Lexington, Mass. 02173

[21] Appl. No.: 306,632

[22] Filed: Feb. 3, 1989

[51] Int. Cl.[4] ..... A63B 51/02

[52] U.S. Cl. ..... 273/73 R

[58] Field of Search ..... 273/73 R, 73 A, 73 B, 273/73 D; 148/156, 402, 441, 443; 57/234; 428/377, 394

[56] References Cited

U.S. PATENT DOCUMENTS

| | | | |
|---|---|---|---|
| 1,279,719 | 10/1918 | Lewis | 273/73 D |
| 1,531,862 | 1/1922 | Lanned | 273/73 D |
| 1,532,703 | 4/1925 | Lanned | 273/73 D |
| 1,615,790 | 1/1927 | Forbes et al. | 273/73 D |
| 2,307,470 | 1/1943 | Salathe, Jr. | 273/73 D |
| 3,999,756 | 12/1976 | Head . | |
| 4,005,863 | 2/1977 | Henry . | |
| 4,013,289 | 3/1977 | Kaminstein . | |
| 4,131,279 | 12/1978 | Ogden . | |
| 4,163,553 | 8/1979 | Renfro . | |
| 4,183,200 | 1/1980 | Bajaj | 273/73 D X |
| 4,190,249 | 2/1980 | Fischer . | |
| 4,505,767 | 3/1985 | Quin . | |
| 4,586,969 | 5/1986 | Tamura . | |
| 4,597,576 | 7/1986 | Haythornwaite . | |
| 4,631,094 | 12/1986 | Simpson et al. | 428/960 |
| 4,665,906 | 5/1987 | Jervis . | |
| 4,732,384 | 3/1988 | Seymour . | |
| 4,767,472 | 8/1988 | Vannette | 248/156 |

FOREIGN PATENT DOCUMENTS 0141006 5/1985 European Pat. Off. .

OTHER PUBLICATIONS

L. Schetky, "Shape—Memory Alloys" in Kirk—Othmer Encyc. Chem. Tech. 20:726–36.

*Primary Examiner*—Edward M. Coven
*Assistant Examiner*—William E. Stoll
*Attorney, Agent, or Firm*—Fish & Richardson

[57] ABSTRACT

In a sports racquet having a frame with a handle and a head defining an open region, a netting of a plurality of tensioned strings in an interwoven grid across the open region is formed of a metal alloy material having high elasticity, i.e., exhibiting linear elastic behavior or exhibiting stress-induced martensite-martensite transformation (super elastic or pseudo elastic) behavior. In one embodiment, the alloy described above, and a sleeve or lower durometer material, e.g., plastic.

11 Claims, 1 Drawing Sheet

SPORTS RACQUET NETTING

The invention relates to netting for racquets used, e.g. in tennis, racquetball, squash, etc.

Racquets consist of a frame, which today may be made of wood, fiber-reinforced plastic, ceramic, steel, graphite, composite or some other suitable material, with a tightly strung netting grid. The netting may typically be nylon or other thermoplastic material. A preferred netting material, due to its optimum properties of elasticity and resiliency, is animal gut, but gut tends to break easily and is unstable in damp weather (it stretches), so thermoplastics are more widely employed. It is known, however, that the netting of such racquets must be replaced periodically, e.g., at least once a year and more often for most players, because of loss of netting tension due to stress-induced relaxation or "creep" the thermoplastic netting material. Also, it is desired that the coefficient of restitution of the ball, or the ratio of ball velocity as it hits the netting of a fixed racquet versus the velocity of the ball as it leaves the netting, be as high as possible in order that minimum ball velocity is lost due to energy absorbtion by the netting, and the player can obtain maximum ball return velocity without having to overswing the racquet and thus risk loss of control and accuracy. Tennis racquets having netting of nylon or the like, and traditional frame head constructions, typically have a coefficient of restitution of about 0.3 to 0.5.

It has been sought to improve the figure by variation of the frame head construction. For example, Head U.S. Pat. No. 3,999,756 describes a racquet having an oversize frame with a larger string surface area, e.g., up to 130 square inches compared to the usual of about 70 square inches, in order to achieve improved coefficient of restitution, e.g., in the small area at the center of percussion, i.e. the "sweet spot" or optimum area for striking the ball with a minimum amount of vibration and truest ball trajectory, a ratio as high as about 0.6 has been claimed.

When a ball strikes a typical netting, the filaments or strings of the netting are stretched and thereby deformed by a give amount before returning toward their original length. Typical netting materials such as thermoplastic, nylon, synthetics or animal gut can be placed under tension during stringing of a racquet frame and thus impart a return force to the ball when elongated by the force of the ball striking the racquet. However, consideration of the stress versus strain analysis curve of such materials (FIG. 3) shows that upon application of stress to a string, e.g. by striking it with a ball, a given amount of strain, i.e. elongation, occurs, but that upon removing the stress the string does not return to its original length because a small amount of permanent elongation (yield) has occured. Also, as a given amount of stress is applied repeatedly over time to the strings of the netting, the amount of stress required to achieve a given amount of strain in response increases due to creep. It is well known that this deterioration of netting tension, and resultant decrease in racquet performance, begins as soon as a newly strung racquet is used.

It has been thought to reduce the loss of racquet performance over time by utilization of piano or guitar strings consisting of a metal coil wire wrapped about a central core wire. Netting of tis construction is thought to exhibit reduced plastic deformation or creep as compared to thermoplastic materials, but due to relatively low elongation, e.g. 0.2 to 0.3 percent, and high durometer, the balls deterioriate rapidly.

SUMMARY OF THE INVENTION

According to the invention, a sports racquet comprising a frame having a handle and a head defining an open region has a netting comprising of a plurality of tensioned string elements disposed in an interwoven grid across the open region, the netting being comprised of a metal alloy material exhibiting stress-induced martensite-martensite transformation (super elastic or pseudo elastic behavior), or exhibiting linear elastic behavior.

In preferred embodiments of this aspect of the invention, the metal alloy material is selected from the group consisting of Nickel-Titanium (Ni-Ti), Silver-Cadmium (Ag-Cd), Gold-Cadmium (Au-Cd), Gold-Copper-Zinc (Au-Cu-Zn), Copper-Aluminum-Nickel (Cu-Al-Ni), Copper-Gold-Zinc (Cu-Au-Zn), Copper-Zinc (Cu-Zn), Copper-Zinc-Aluminum (Cu-Zn-Al), Copper-Zinc-Tin (Cu-Zn-Sn), Copper-Zinc-Xenon (Cu-Zn-Xe), Iron Beryllium ($Fe_3Be$), Iron-Platinum ($Fe_3Pt$), Indium-Thallium (In-Tl) and Titanium-Nickel (Ti-Ni), Nickel-Titanium-Vanadium (Ni-Ti-V), Iron-Nickel-Titanium-Cobalt (Fe-Ni-Ti-Co) and Copper-Tin (Cu-Sn).

According to another aspect of the invention, the netting comprises a core of relatively high durometer material and a sleeve or coating about the core is of relatively lower durometer.

In preferred embodiments of this aspect of the invention, the material of the core comprises metal or a metal alloy material exhibiting stress-induced martensite-martensite transformation (super elastic or pseudo elastic behavior), e.g. selected from the group described above. The sleeve or coating comprises a synthetic polymeric material, e.g., selected from the group consisting of nylon, polyurethane and polyethylene.

Thus there is provided a sports racquet with a netting that provides consistent performance over an extended period of playing time, without requiring frequent restringing.

These and other features and advantages will be seen from the following description of a presently preferred embodiment, and from the claims.

PREFERRED EMBODIMENT

We first briefly describe the drawings:

FIG. 4 is a face view of a squash racquet strung with an alternate embodiment of the netting of the invention; while

Figure 1:
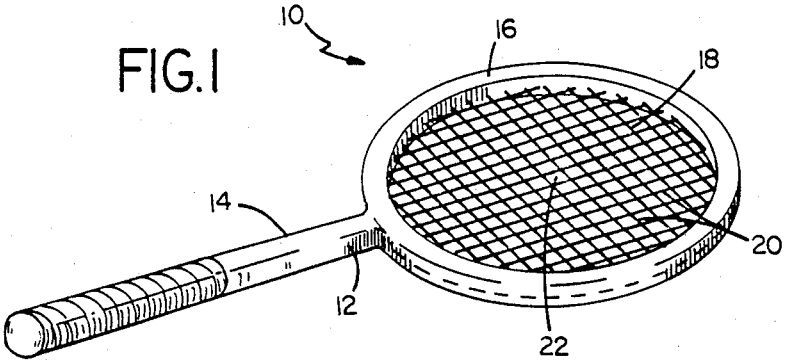
FIG. 1 is a face view of a typical tennis racquet strung with the netting of the invention.

Referring to FIG. 1, a sports racquet, in this case a tennis racquet 10, has a frame 12 with a handle 14 and a head 16. The frame may be formed of any suitable material such as wood, fiber reinforced plastic, ceramic, steel, graphite, boron, extruded aluminium or a composite of any of these materials.

A netting 18 consisting of an interwoven grid of tensioned horizontal and vertical strings 20 spans the opening 22 defined by the head of the racquet. According to the invention, the netting 18 is preferably formed of a metal alloy exhibiting stress-induced martensite-martensite transformation (or so-called "superelastic" or "pseudo elastic" behavior) or linear elastic behavior. These alloy materials have been shown to be able to undergo repeated stress deformation and each time return to their original pristine state when the stress is removed, without any permanent or plastic deformation.

Figure 2:
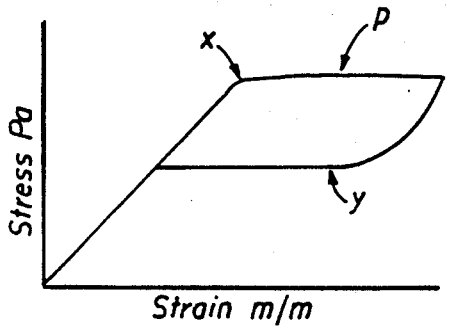
FIG. 2 is a stress versus strain analysis curve for a netting material of the invention.

Referring to the stress versus strain curve of FIG. 2, it is seen that when a superelastic alloy is placed in tension and stress is increased, the strain increases proportionately to a point (X) where the material undergoes a transformation. Thereafter, stress remains constant while strain is increased, forming a constant stress plateau (P). In this region of tress, the netting material is reversably deformable and returns to its original length on curve (Y). This cycle occurs repeatedly, without appreciable change in dimension or plastic deformation, and the netting of the invention achieves elasticity of about 3 to 8 percent, with recoverable strains as high as 17 percent observed (compared to 0.5 to 0.8 percent typical of steel or titanium or other similar alloys).

The netting 18 of racquet 10 is preferably formed of a nickel-titanium system commonly referred to as Nitinol (Nickel-Titanium Naval Ordinance). Other alloys exhibiting the desired properties include, e.g., Silver-Cadmium (Ag-Cd), Gold-Cadmium (Au-Cd), Gold-Copper-Zinc (Au-Cu-Zn), Copper-Aluminum-Nickel (Cu-Al-Ni), Copper-Gold-Zinc (Cu-Au-Zn), Copper-Zinc (Cu-Zn), Copper-Zinc-Aluminum (Cu-Zn-Al), Copper-Zinc-Tin (Cu-Zn-Sn), Copper-Zinc-Xenon (Cu-Zn-Xe), Iron Beryllium ($Fe_3Be$), Iron-Platinum ($Fe_3Pt$), Indium-Thallium (In-Tl) and Titanium-Nickel (Ti-Ni) (Schetsky, L. McDonald, "Shape Memory Alloys", *Encyclopedia of Chemical Technology* (3rd ed.), John Wiley & Sons, 1982, vol. 20, pp. 726–736); also Nickel-Titanium-Vanadium (Ni-Ti-V), Iron-Nickel-Titanium-Cobalt (Fe-Ni-Ti-Co) and Copper-Tin (Cu-Sn).

Figure 3:
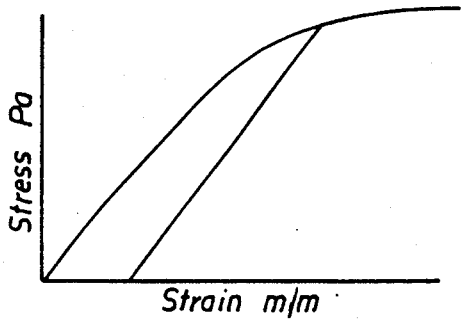
FIG. 3 is a stress versus strain analysis curve for a typical sports racquet thermoplastic netting material.
Figure 2A:
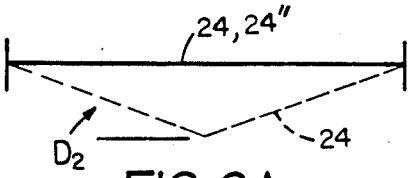
FIGS. 2A and 3A are diagrammatic representations of netting strings exhibiting the stress versus strain characteristics of FIGS. 2 and 3, respectively.
Figure 3A:
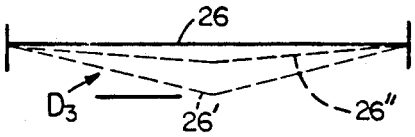

The strings 20 of netting 18 are strung in racquet 10 at a tension selected to cause the material of the netting to exhibit the stress versus strain characteristics of the curve of FIG. 2. As a result, increased force (stress) applied to the netting resulting from impact upon the ball results in at least a near perfect elastic response from th netting, and a coefficient of restitution approaching 1.0. This is represented in FIG. 2A, in which the tensioned string 24 of the invention deflects elastically upon impact with the ball, indicated by dashed line position 24', and returns to approximately the original position 24''. In contrast, referring again to the stress versus strain curve of FIG. 3, and to the representation of FIG. 3A, a string 26 of thermoplastic or similar material undergoes the stress versus strain curve shown, with the resultant yield or plastic deformation, the string deflecting upon impact with the ball to the dashed line position 26', but returning only partially toward the original position, indicated diagrammatically by dotted line 26'', and some of the energy of collision is lost.

In a racquet having netting of the invention, the coefficient of restitution is an inherent property of the netting, rather than a function of racquet frame size, shape or stringing. Also, the so-called "sweet spot" is enlarged, as compared to similar frames, and the racquet playing surface is more uniform.

Also, the netting 18 of the invention provides increased dwell or residence time of the ball on the netting surface, compared to similar racquet frame constructions. Control of a ball on return is a function of the time that the ball is in contact with the netting surface. Increased dwell time allows a player to impart top or under spin and otherwise control the direction of the ball. Typically the dwell time is a compromise with speed of the return. The netting of the invention has more elasticity than thermoplastic netting now in use and as a result provides significantly increased dwell time. In order to exhibit the improvement, two aluminum tennis racquets having the same surface area (110 square inches) were strung to the about the same tension (50 to 60 pounds). The first racquet had a standard netting of nylon. The second racquet had a netting of the invention, in this case nylon-coated Nitinol, as described below.

The "dwell time" of the ball on the strings is calculated by assuming that the strings act like springs, and using the following equation:

$$F=K\Delta X$$

Where K =the spring constant, determined with a strain gauge used to measure the mount of force necessary to achieve a constant deflection ($\Delta X$).

It was determined that the spring constant of the nylon netting was 110 lbs/inch while the spring constant of the netting of the invention was 90 lbs/inch, or 20% less, so that a tennis ball travelling at the same speed will deflect the netting 20% more and thus spend 20% more time on the racket for $D_2$, vs $D_3$.

In another example of the invention, the same aluminum racket was strung at 45–50 lbs with a netting of nylon coated, linearly elastic Nickel-Titanium alloy. The spring constant measured as above was 78 lbs/inch or 30% less than the nylon netting. It follows that a player using a racquet with the netting of the invention is able to return the ball with relatively more accuracy and control without loss of speed.

Figure 4:
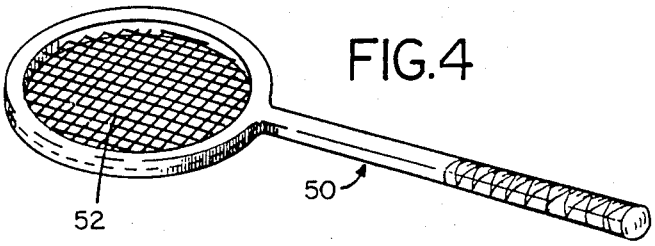
Figure 4A:
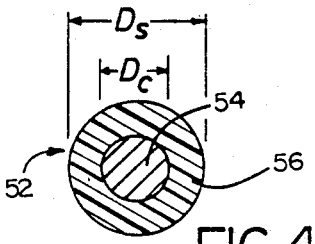
FIG. 4*a* is a cross section view of the netting strings of FIG. 4.

Referring now to FIG. 4, according to another aspect of the invention, a sports racquet (e.g. a squash racquet 50 is shown) has a netting 52 consisting of a core 54 (FIG. 4A) of metal or other high durometer material within a sleeve 56 of lower durometer material. Typically the core may have a diameter $D_c$ of the order of about 0.025 inch while the sleeve has an outer diameter $D_s$, of the order of about 0.035 inch, compared to the typical outer diameter of prior art strings of thermoplastic of the order of about 0.050 inch.

In the preferred embodiment, the core material is Nitinol or other alloy exhibiting elastic behavior as described above, but core wires of high durometer material such as steel, titanium or other materials such as Kevlar® aramide fibers, graphite or glass will also provide some of the advantages described below. The sleeve is preferably polyurethane, nylon or polyethylene or other material of desired tack and hardness, e.g., applied to the core by extrusion coating. The high durometer material of the core provides improved elasticity and increased useful life as compared, e.g., thermoplastic netting, while the sleeve reduces wear on the ball typical with metal strings and increases the ball dwell time. The preferred netting of superelastic material further provides all of the other advantage described above.

In both aspects of the invention, the netting of the invention can be matched to frame size and material for optimun performance.

Other embodiments of the invention are with the following claims. For example, the sleeve material 56 about the core may be applied by coating.

What is claimed is:

1. In a sports racquet comprising: a frame having a handle and a head defining an open region, and a netting comprising a plurality of tensioned string elements disposed in an interwoven grid across said open region, the improvement wherein said netting is comprised of a metal alloy material exhibiting stress-induced martensite-martensite transformation of super elastic or pseudo elastic behavior.

2. In a sports racquet comprising: a frame having a handle and a head defining an open region, and a netting comprising a plurality of tensioned string elements disposed in an interwoven grid across said open region, the improvement wherein said netting is comprised of a metal alloy material exhibiting linear elastic behavior.

3. The sports racquet of claim 1 or 2 wherein said metal alloy material is selected from the group consisting of Nickel-Titanium (Ni-Ti), Silver-Cadmium (Ag-Cd), Gold-Cadmium (Au-Cd), Gold-Copper-Zinc (Au-Cu-Zn), Copper-Aluminum-Nickel (Cu-Al-Ni), Copper-Gold-Zinc (Cu-Au-Zn), Copper-Zinc (Cu-Zn), Copper-Zinc-Aluminum (Cu-Zn-Al), Copper-Zinc-Tin (Cu-Zn-Sn), Copper-Zinc-Xenon (Cu-Zn-Xe), Iron Beryllium ($Fe_3Be$), Iron-Platinum ($Fe_3Pt$), Indium-Thallium (In-Tl), Titanium-Nickel (Ti-Ni), Nickel-Titanium-Vanadium (Ni-Ti-V), Iron-Nickel-Titanium-Cobalt (Fe-Ni-Ti-Co) and Copper-Tin (Cu-Sn).

4. In a sports racquet comprising a frame having a handle and a head defining an open region, and a netting comprising a plurality of tensioned string elements disposed in an interwoven grid across said open region, the improvement wherein the string elements of said netting comprise a core of relatively high durometer material and a sleeve about said core of relatively lower durometer said relatively high durometer material comprising a metal alloy material exhibiting stress-induced martensite-martensite transformation of super elastic or pseudo elastic behavior.

5. The sports racquet of claim 4 wherein the material of said core comprises metal.

6. The sports racquet of claim 4 wherein said core comprises a metal alloy material exhibiting linear elastic behavior.

7. The sports racquet of claim 4 or 6 wherein said metal alloy material is selected from the group consisting of Nickel-Titanium (Ni-Ti), Silver-Cadmium (Ag-Cd), Gold-Cadmium (Au-Cd), Gold-Copper-Zinc (Au-Cu-Zn), Copper-Aluminum-Nickel (Cu-Al-Ni), Copper-Gold-Zinc (Cu-Au-Zn), Copper-Zinc (Cu-Zn), Copper-Zinc-Aluminum (Cu-Zn-Al), Copper-Zinc-Tin (Cu-Zn-Sn),Copper-Zinc-Xenon (Cu-Zn-Xe), Iron Beryllium ($Fe_3Be$), Iron-Platinum ($Fe_3Pt$), Indium-Thallium (In-Tl), Titanium-Nickel (Ti-Ni), Nickel-Titanium-Vanadium (Ni-Ti-V), Iron-Nickel-Titanium-Cobalt (Fe-Ni-Ti-Co) and Copper-Tin (Cu-Sn).

8. The sports racquet of claim 4 wherein said sleeve is comprised of a synthetic polymeric material.

9. The sports racquet of claim 8 wherein said synthetic polymeric material is selected from the group consisting of nylon, polyurethane and polyethylene.

10. The sports racquet of claim 1 or 4 wherein said string elements have an outer diameter of the order of about one-half the diameter of typical thermoplastic racquet string.

11. The sports racquet of claim 10 wherein said string elements have an outer diameter of the order of less than about 0.035 inch.

* * * * *

UNITED STATES PATENT AND TRADEMARK OFFICE

CERTIFICATE OF CORRECTION

PATENT NO. : 4,909,510

DATED : March 20, 1990

INVENTOR(S) : Ronald A. Sahatjian

It is certified that error appears in the above-identified patent and that said Letters Patent is hereby corrected as shown below:

ON TITLE PAGE:

In the References cited, #2 and #3: "Lanned" should be --Larned--.

In the Abstract line 8: after "embodiment, the" insert --strings have a core of high durometer material, e.g., the metal--.

In the Specification

Col. 1, line 66; "tis" should be --this--;
Col. 3, line 48; "th" should be --the--;
Col. 6, line 6; insert --,-- after "durometer";
line 35; insert --a-- after "of".

Signed and Sealed this

Twelfth Day of May, 1992

*Attest:*

DOUGLAS B. COMER

*Attesting Officer*

*Acting Commissioner of Patents and Trademarks*